US005429236A

United States Patent [19]

Evans

[11] Patent Number: 5,429,236

[45] Date of Patent: Jul. 4, 1995

[54] CONTAINER SUPPORT

[75] Inventor: Evan D. Evans, North Caulfield, Australia

[73] Assignee: Wangaratta Industries Pty. Ltd., Victoria, Australia

[21] Appl. No.: 54,215

[22] Filed: Apr. 30, 1993

[30] Foreign Application Priority Data

May 1, 1992 [AU] Australia ..... PL2217
Oct. 8, 1992 [AU] Australia ..... PL5160

[51] Int. Cl.[6] ..... B65D 19/04

[52] U.S. Cl. ..... 206/386; 108/55.1; 220/571

[58] Field of Search ..... 108/51.1, 55.1, 55.3, 108/901; 206/386, 596, 598, 599; 220/571, 571.1, 572, 573

[56] References Cited

U.S. PATENT DOCUMENTS

| | | | |
|---|---|---|---|
| 3,193,093 | 7/1965 | Hansen | 108/53.1 |
| 3,367,529 | 2/1968 | Welch et al. | 220/572 |
| 3,783,800 | 1/1974 | Bucker | 108/53.5 |
| 3,920,144 | 11/1975 | Callen | 220/571 |
| 4,407,878 | 10/1983 | Smith et al. . | |
| 4,838,178 | 6/1989 | Chriske et al. . | |
| 4,895,250 | 1/1990 | Schifrin | 206/223 |
| 4,930,632 | 6/1990 | Eckert et al. | 108/55.1 |
| 5,020,667 | 6/1991 | Bush . | |
| 5,036,976 | 8/1991 | Sechler et al. | 108/51.1 |
| 5,092,251 | 3/1992 | Hamaker et al. . | |
| 5,249,699 | 10/1993 | Williams | 108/51.1 |

FOREIGN PATENT DOCUMENTS

| | | | |
|---|---|---|---|
| 0303264 | 2/1989 | European Pat. Off. | 206/386 |
| 0314958 | 5/1989 | European Pat. Off. | 206/571 |
| 2650288 | 5/1978 | German Dem. Rep. | 206/386 |

*Primary Examiner*—Jimmy G. Foster
*Attorney, Agent, or Firm*—Oliff & Berridge

[57] ABSTRACT

A combined bund and pallet for supporting a container during transport or storage and having a base and an integral side wall upstanding from that base and surrounding a material collection space. A support such as an open grid is provided within the area surrounded by the side wall so as to provide a support for the container and hold it above the base. A relatively clear collection space is thereby provided between the base and the bottom of the container. In some embodiments, anti-surge baffles may intrude into that space.

25 Claims, 6 Drawing Sheets

FIG 11
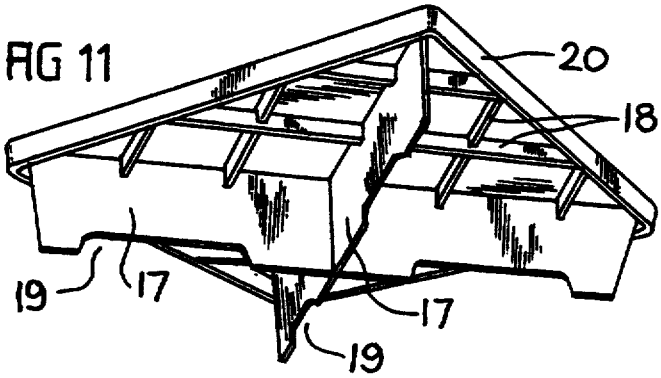
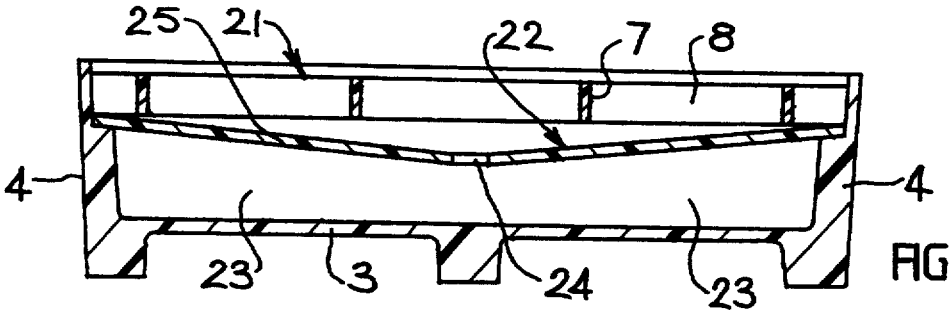
FIG 12
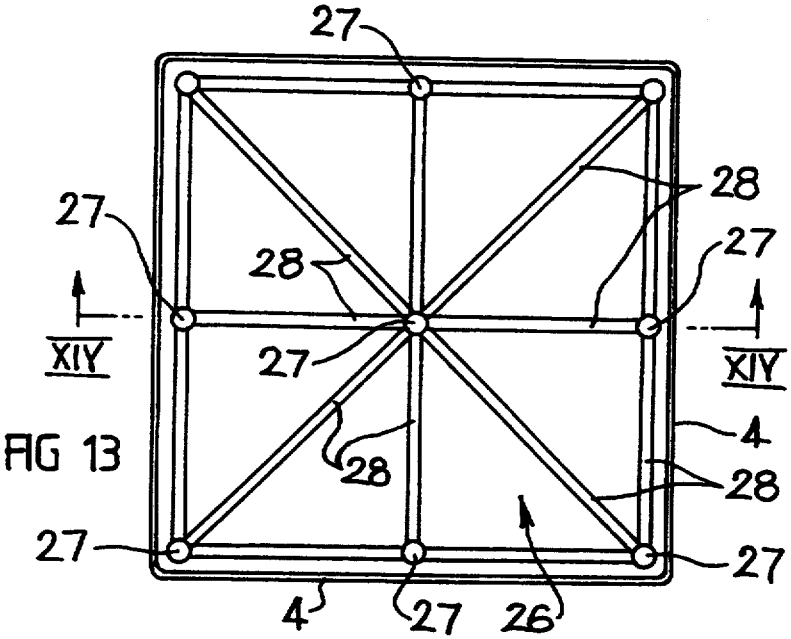
FIG 13
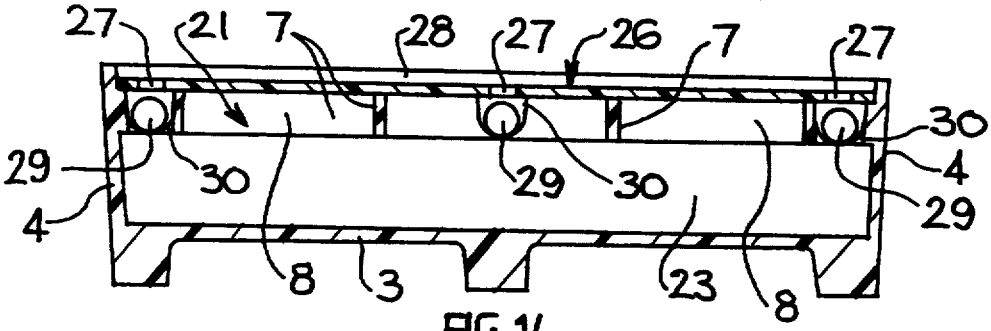
FIG 14

CONTAINER SUPPORT

This invention relates to a support for flowable material containers such as drums. It will be convenient to hereinafter describe the invention with particular reference to a support for drums containing hazardous liquids, but it is to be understood that the invention has wider application.

Regulations dealing with the storage of drums containing flammable or otherwise hazardous liquids, generally require that the drums be located in a bund which provides a cavity or recess for collecting and retaining liquid which leaks or spills from one or more of the drums. Such bunds are commonly fixed in place so that movement of a drum from one location to another requires transfer of the drum from one bund to another bund.

It is an object of the present invention to provide a container support or pallet which is transportable from one location to another and which functions as a bund both during transport and when positioned at a selected site. It is a further object of the invention to provide such a support which is capable of simultaneously supporting a plurality of drums and which is adapted to be lifted and moved by a forklift unit so as to function in the manner of a conventional pallet.

According to the present invention there is provided a combination bund and pallet for supporting at least one container during storage or transport of that container, including a base, a continuous side wall upstanding from said base and formed integral with the base, a collection space for flowable material surrounded by said side wall, container supporting means extending between opposed parts of said side wall and being operable to support said container above said base, and at least one opening in said supporting means for passage of flowable material into said space.

The size of the collection space will be determined according to the nature of the relevant controlling regulations and the size and/or number of containers to be supported. In one arrangement, as hereinafter particularly described, the combined bund and pallet is generally in the form of a substantially flat tray, and consequently it will be convenient to hereinafter refer to the device as a support tray.

In one particularly satisfactory arrangement, the support tray is of rectangular form in plan view and the supporting means holds each drum above the base of the tray clear of intrusion into the collection space of the tray. The supporting means can be of any suitable form, such as a plurality of laterally spaced bars or rods extending over the tray base and supported at the side wall.

Preferably, there are at least two groups of such bars or rods which are relatively arranged so that the bars or rods of one group extend angularly relative to the bars or rods of the other. The arrangement is such that the two groups form a grid on which the or each container rests, and the grid openings enable material spilt or leaking from a container to fall into the collection zone below.

Embodiments of the invention are described in detail in the following passages of the specification which refer to the accompanying drawings. The drawings, however, are merely illustrative of how the invention might be put into effect, so that the specific form and arrangement of the various features as shown is not to be understood as limiting on the invention.

In the drawings

FIG. 11 is a perspective view of yet another baffle arrangement for use with a support according to the invention;

FIG. 12 is a cross-sectional view of a container support including yet another baffle arrangement;

FIG. 13 is a plan view of a container support including still another baffle arrangement;

FIG. 14 is a cross-sectional view taken along line XIV—XIV of FIG. 13;

Figure 3:
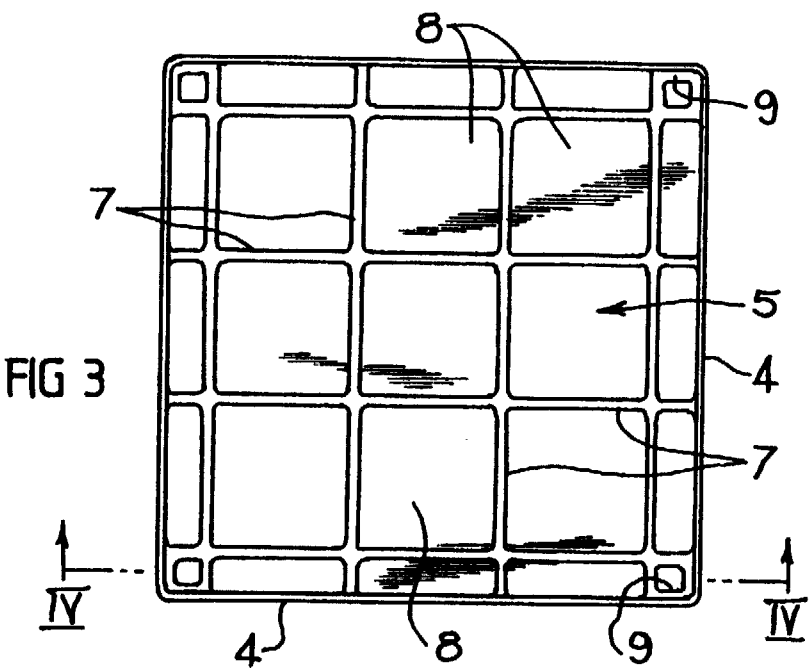
FIG. 3 is a top plan view of the support of FIG. 1.

The container support 1 shown in the drawings includes a transportable body 2 which is of tray-like form and has a substantially flat base 3 around the periphery of which extends an upstanding continuous side wall 4. The base 3 and the side wall 4 are formed integral and combine to form an open topped cavity 5 which functions as a collection zone for liquid or other flowable material. The depth and the lateral extent of the cavity 5 can be determined to suit particular requirements. That is, the cavity 5 is dimensioned so as to have a volumetric capacity such as to suit the particular conditions of use of the support 1.

The support 1 as shown in the drawings is substantially square in plan view, but it could be of any other shape, including other rectangular shapes.

In the preferred form shown, the support 1 is adapted to be lifted and moved by a forklift unit. For that purpose, it is preferred to provide the support 1 with a plurality of feet 6 which extend below the base 3. The feet 6 are dimensioned to hold the base 3 above the ground or a floor by a distance sufficient to permit the forks of a forklift unit to be located beneath the base 3.

It is preferred that the support 1 be arranged so that the drums, or other containers, mounted on the support do not intrude, at least significantly, into the collection zone formed by the cavity 5. That is, at least the bulk of the collection zone is preferably located beneath the drums. That result can be achieved in a number of ways. In the particular arrangement shown, the desired result is achieved by elevated means in the form of laterally spaced bars 7 or rods extending across the cavity 5 and located in vertically spaced relationship to the base 3.

The preferred arrangement shown in the drawings includes two groups of bars 7 which are arranged at right angles to one another. The bars of one group extend between two opposed sides of the body 2, and the other group extends between the other two opposed sides. The number and spacing of the bars 7 in each group can be selected to suit requirements.

Figure 4:
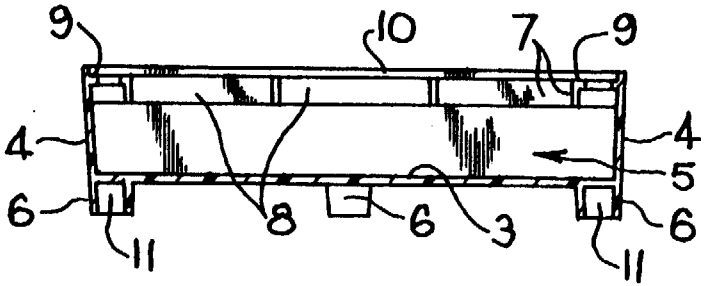
FIG. 4 is a sectional view taken along line IV—IV of FIG. 3.

It is preferred that each end of each bar 7 is secured to or formed integral with the side wall 4 as best seen in FIG. 4. That leaves a clear space between the bars 7 and the base 3 so as to maximize the volume of the collection zone. If desired however, one or more support posts could be provided between the base 3 and one or more of the bars 7.

Figure 1:
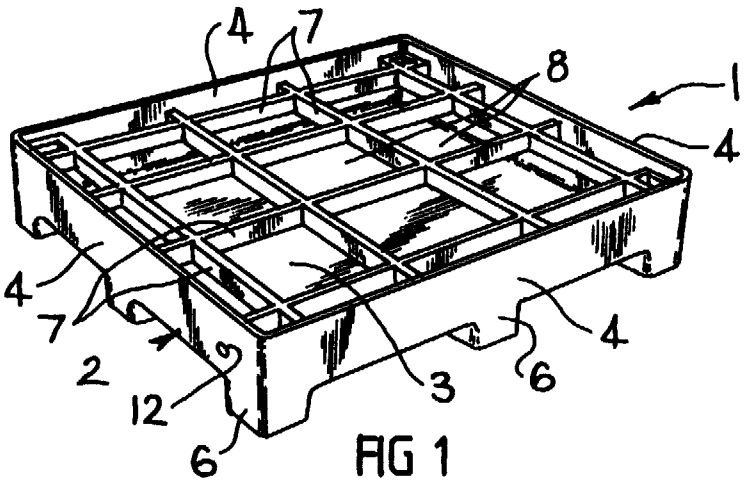
FIG. 1 is a top perspective view of a container support according to one embodiment of the invention.

The two groups of bars 7 form a grid arrangement as best seen in FIGS. 1 and 4, and any liquid which leaks or spills from a drum located on that grid can fall through the grid openings 8 for retention in the collection space formed by that part of the cavity 5 which is beneath the grid.

It will be appreciated that the grid can be different in appearance to that shown in the drawings. For example, the bars 7 may extend diagonally relative to the sides of the body 2, or there may be a plurality of ring-like grid sections interconnected by radially extending bar sections. Other grid configurations could be adopted. Furthermore, the grid may be formed separate from the body 2, and is that event the grid and body may be made of different materials. For example, the body 2 may be made of metal and the grid may be made of a plastics material.

In the particular arrangement shown, the bars 7 are disposed below the top edge of the side wall 4 so that a shallow space 10 is formed within the wall 4 above the bars 7. That permits the feet 6 of one support to be received in the space 10 of another support 1 so that a number of supports 1 can be safely stacked one upon the other. A pad 9 may be formed at each corner as shown in FIGS. 3 and 4 to provide a surface for engagement by the feet 6 of an overlying support 1.

As best seen in FIG. 4, each foot 6 is formed with a downwardly opening socket 11 which can receive the upper end of a post or column (not shown) such that the support 1 can be held in an elevated position above the ground or floor. Other arrangements could be adopted for the same purpose.

Figure 2:
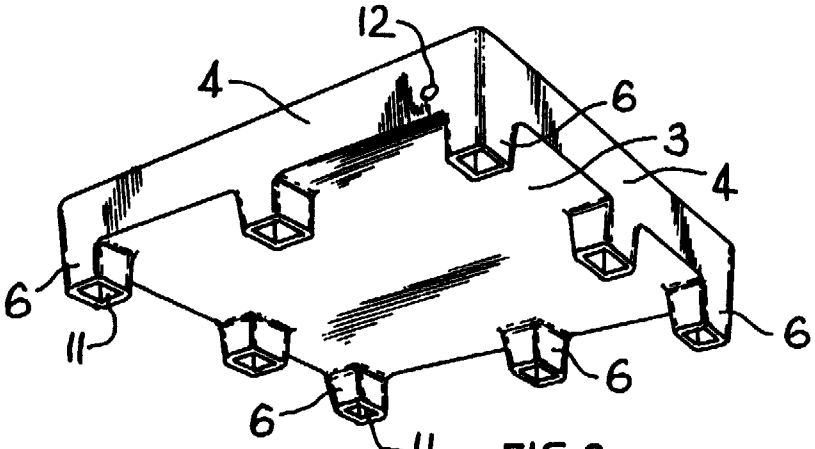
FIG. 2 is a bottom perspective view of the support of FIG. 1.
Figure 5:
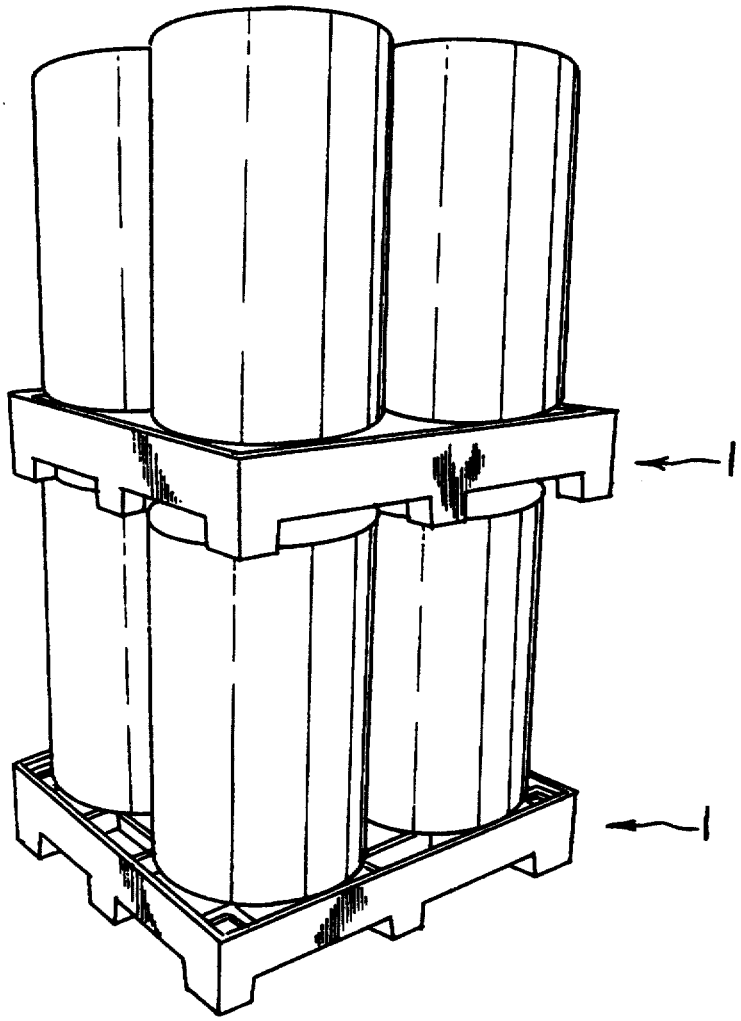
FIG. 5 is a perspective view of a pair of container supports stacked one above the other with each support carrying a number of 200 liter drums.

If desired, the support 1 may be provided with a drain port 12 (FIGS. 1 and 2) through which liquid can be removed from the cavity 5. The port 12 could be closed by a suitable bung, but is preferably controlled by a valve or tap (not shown) and it is further preferred that any such valve or tap is lockable to prevent inadvertent or unauthorised opening of that valve or tap.

The support 1 may be dimensioned so as to have substantially the same lateral extent as a standard pallet. That enables the support to receive a pallet with drums already on the pallet, and perhaps bound to the pallet by shrink wrap packaging, for example. In that regard, the pallet may be receivable in the shallow space 10 (FIG. 4) so as to be held against lateral shifting relative to the support 1.

Furthermore, the body 2 may be adapted to receive a frame (not shown) on its upper surface for holding one or more drums in a horizontally extending position to facilitate the decanting of liquid therefrom. Alternatively, the support 1 may be constructed so as to only receive drums in the horizontal disposition.

In use, drums filled with liquids can be loaded onto a container support 1 at a source point and then moved together with the support 1 to a suitable storage site. If at a later stage, the drums are required to be moved, they can simply be moved together with the support 1 as a single entity. Should any liquid leak out of the drums, whether during handling or while in storage, the liquid will be captured and retained in the collection zone of the cavity 5.

As and when required, liquid can be drained from the cavity 5 by authorized personnel and disposed of safely in an appropriate manner.

The body 2 may be made of metallic material such as iron, for example malleable and ductile SG iron, stainless steel, for example 316 stainless steel, or the like. Alternatively the body 2 may be made of plastics material such as polyurethane, polypropylene or the like. It is to be appreciated however that any other material capable of forming a suitably durable and robust article could be used.

In one particular example, the body 2 is formed by means of a casting operation and the material used is spheroidal graphite iron, which is noted for its ductile nature. Subsequent to casting, exposed surfaces of the body 2 may be coated with a corrosion resistant material or paint to enhance the corrosion resistance of the product. By way of example, a coat of paint having corrosion resisting properties may be applied to the outside surfaces of the body 2, and another corrosion resistant material may be applied to inside surfaces.

According to one arrangement, a corrosion resistant laminate is applied to the support 1, or at least to those surfaces of the support 1 which are exposed to material collected in the collection space extending over the base 3. Such a laminate can be formed in a variety of ways and of a variety of materials. It is preferred however, that the laminate is composed of two layers and that the inner layer is hard by comparison with the outer layer. It is further preferred that each of the two layers is applied by spraying, although other application techniques such as dipping could be used. Each layer may have a thickness of approximately 100 microns, but other thicknesses could be selected to suit particular requirements.

One laminate which has been found to be particularly satisfactory is composed of materials of the following kind. The inner layer is a phenolic modified amine cured epoxy which, when cured, is extremely hard and has a very smooth surface. One material of that kind is identified as juton 418. The outer layer is a chloro-sulphinated polyethylene, and one suitable material of that kind is sold under the trade mark Hypalon. The second layer is preferably sprayed over the first layer before that first layer is completely cured (fully dried) so as to achieve a strong bond between the two layers.

A laminate of the foregoing kind has an inner layer of hard durable material which is chemically resistant, and an outer layer of relatively resilient chemically resistant material which is also resistant to chipping and cracking. The end result is an effective protection against corrosion of the material substrate, which may be spheroidal graphite iron for example.

Special problems are associated with transporting drums from one location to another. If the contents of a drum leaks or spills during transport, the bund or other device which captures the leakage or spillage will need to have special characteristics if it is to retain the captured material against escape. Movement of the transporting vehicle, and acceleration and deceleration of that vehicle, will induce movement in the body of the captured material such that that material will tend to splash and/or spill out of the device intended to retain it.

A container support according to the present invention can be provided with anti-surge means which functions to minimize turbulence, and movement in general, of liquid or other flowable material which is contained in the support 1. That liquid or other material may be present as a consequence of leakage or spillage from the container carried by the support 1. According to another possible arrangement, the container support 1 may include an anti-surge cover, or partial cover, which hinders escape of captured material from the retention space of the support 1.

Anti-surge means of the foregoing kind may be adapted to be associated with and removed from the support 1 according to requirements. In the alternative, such means could be a permanent or non removable part of a support 1.

Figure 6:
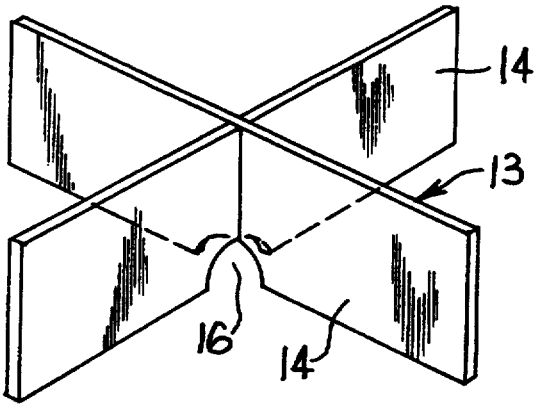
FIG. 6 is a perspective view of a baffle arrangement for use with the container support of FIGS. 1 to 4.
Figure 7:
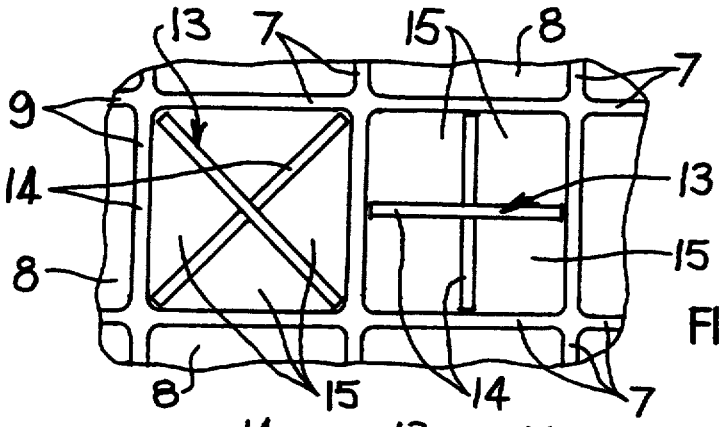
FIG. 7 is a plan view of part of the container support showing two alternative arrangements for including a baffle of the kind shown in FIG. 6.

According to one particular arrangement which is shown by FIG. 6, the anti-surge means includes a baffle 13 in the form of a pair of crossed plates 14 which can be inserted into the body 2 of the support 1 through one of the grid openings 8. Any number of such baffles 13 may be associated with a particular support 1, according to requirements, and the baffle 13 can be disposed in either of the alternative arrangements shown in FIG. 7. It will be apparent that the length of each plate 14 will be selected so that the baffle 13 can fit through a grid opening 8 to be positioned according to either of the alternatives illustrated by FIG. 7. It is to be understood however, that a suitable baffle could be composed of one plate or a number of plates greater than two.

The baffle 13 operates to compartmentalize the material collection space within the support 1, and in that way hinder movement, or the build-up of movement, of liquid across the base 3. Such a baffle 13 may be provided in one or more of the grid openings 8 according to requirements, and is preferably adapted for removal as needed.

Figure 8:
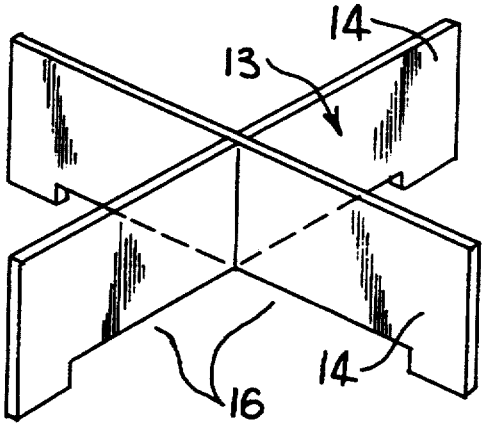
FIG. 8 is a view similar to FIG. 6 but showing an alternative baffle arrangement.
Figure 9:
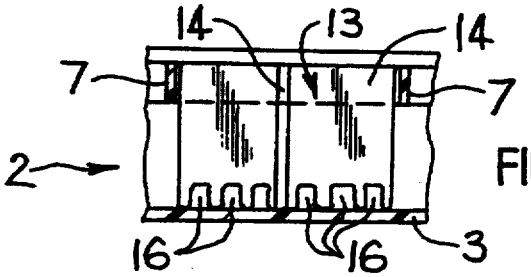
FIG. 9 is a cross-sectional view taken through part of a container support showing another baffle arrangement.

Various means may be adopted to permit liquid to move between the compartments 15 (FIG. 7) formed by the baffles 13. Such movement can occur beneath the bars 7 of the grid, and/or through the gap between adjacent edges of the plates 14 of adjacent baffles 13. If desired, one or more flow openings 16 may be provided in the lower edge of at least one of the plates 14 of a baffle 13, and some of the possiblities in that regard are illustrated by FIGS. 6, 8 and 9. Obviously, the number, size and location of the openings 16 can vary according to requirements.

Figure 10:
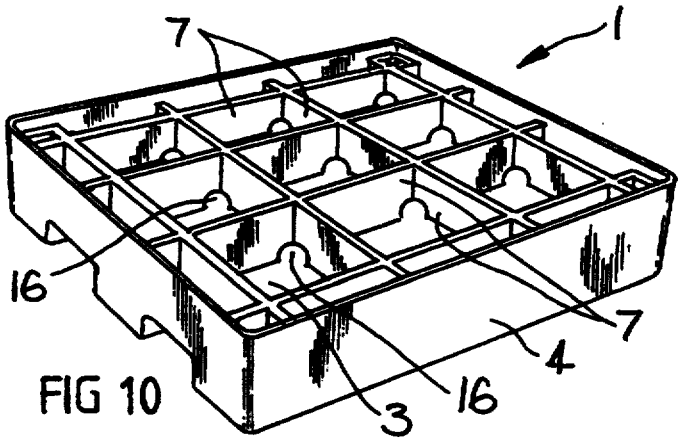
FIG. 10 is a view similar to FIG. 1 but showing another form of container support according to the invention.

The baffles 13 described above are removable from the support 1, but baffles of the same or similar form could be fixed to or formed integral with the grid and/or the support base 3. Two possible arrangements of the foregoing kind are shown by FIGS. 10 and 11. In the former case, the bars 7 of the grid are extended downwards to form the baffles, and flow opening 16 similar to those of the FIG. 6 arrangement, are provided. FIG. 11 omits the body 2 of the support for convenience of illustration, and in the arrangement shown baffle plates 17 are used in place of some of the grid bars 18, and flow openings 19 are provided in the lower edges of those plates similar to the FIG. 8 arrangement. The grid is carried by a frame 20 which is receivable in the space 10 of the support 1.

The FIG. 10 arrangement, or a variation thereof, is particularly suitable for manufacture from a plastics material such as polyethylene which has the desirable characteristic of broad spectrum resistance to chemicals. An arrangement such as that shown in FIG. 10 can be moulded or otherwise formed as a single piece construction. In particular, the grid (baffles), side wall 4 and base 3 may be integral. Since the baffle plates which form the grid extend to the base 3, they function as structural members in the sense that any load received is transferred through them directly into the base 3. Buckling or deflection of the grid is thereby avoided. The base 3 of the FIG. 10 arrangement may be arranged so that it has maximum area contact with the ground or other supporting surface. The aim is to enable the support 1 to carry a load without sagging or warping, which is a problem with prior pallets formed of plastics materials.

In another variation, an example of which is shown in FIG. 12, a removable grid 21 is utilized so as to permit a baffle 22, or a series of baffles, of suitable form to be placed in and removed from the support 1 according to requirements.

Baffles of the kind referred to above, apart from that shown in FIG. 12, perform their anti-surge function by dividing the interior of the support collection space into a plurality of compartments (which may be interconnected) and thereby reducing the distance across which liquid can move before encountering a barrier. Such reduction in the distance travelled by moving liquid naturally tends to reduce the build-up of momentum in the liquid body and consequent wave formation which can result in splashing and/or overflow.

Another approach to the problem is to provide an anti-surge cover over at least part of the support collection space. Such a cover may be arranged to permit leakage and spillage from a container to enter the collection space, but nevertheless hinder movement of the received liquid out of that space.

A relatively simple example of the foregoing approach is illustrated by FIG. 12. In that arrangement, a baffle plate 22 is located beneath the grid 21 (which may be removable) and provides a substantial cover over the collection space 23. An opening 24 is formed through the plate 22, preferably at its center, and the upper surface 25 of the plate 22 slopes towards that opening 24. Liquid or other flowable material which is deposited on the plate surface 25 due to container spillage or leakage therefore migrates down that surface to enter the space 23 through the opening 24. Liquid collected in the space 23 however, has difficulty escaping to the region above the plate 22, and that difficulty can be optimized by providing a suitable seal between the periphery of the plate 22 and the support walls 4.

It will be appreciated that the plate 22 could be modified to have one or more drainage holes additional to the central opening 24, and such additional holes can be positioned to suit requirements. If desired, a non return valve (for example as hereinafter described) may be associated with the opening 24 and/or each of the additional holes.

FIGS. 13 and 14 illustrate another arrangement in which a baffle plate 26 is located over the grid 21. The plate 26 may be removable, and suitable sealing means is preferably provided between the periphery of the plate 26 and the support walls 4.

A plurality of drainage openings 27 are provided through the plate 26, and at least some of those openings 27 are interconnected through a series of gutters or channels 28 formed in the upper surface of the plate 26. It is to be understood that the number and location of the openings 27 need not be as shown in FIG. 13, and similarly for the number and location of the channels 28. The selected arrangement will generally be such as to minimise the possibility of container leakage or spillage escaping over the top edge of the side walls 4, and to maximize inducement of any such leakage or spillage to enter the space 23 through one or more of the opening 27.

Escape of liquid from the space 23 can be hindered by use of non-return valves or the like at each opening 27. Such valves could take any appropriate form, but in the arrangement shown each includes a ball 29 which floats and is larger than the opening 27, and a cage 30 which retains the ball 29 in close association with the respective opening 27. If liquid attempts to pass from the space 23 through a particular opening 27, the associated ball 29 will be lifted by that liquid to close the opening 27.

If desired, the upper surface of the plate 26 may be dished or otherwise arranged to promote movement of liquid towards the center and the radiating channels 28. In addition, or as an alternative, the base of each channel 28 may slope so as to direct flow towards the center of the plate 26 or towards an adjacent opening 27.

The anti-surge arrangements illustrated and described are examples of the large number of possibilities which are available. Also, each of the examples illustrated is open to variation. One possible variation of either of the arrangements of FIGS. 12 and 13 is to add downwardly depending baffle plates—e.g., similar to those of FIGS. 6 to 9—to the cover plate 22 or 26, whichever is the case. That is, such downwardly depending baffle plates could be secured to the underside of the plate 22 or 26 in any appropriate fashion and in any appropriate arrangement. In the case of the FIG. 13 embodiment, the additional baffle plates would need to be arranged to penetrate through the grid openings 8.

Any of the anti-surge devices described can be formed of any suitable material including metals and plastics materials. It will be appreciated from the foregoing that the baffle arrangements described provide a substantial advantage in enhancing the usefulness and security of retention of any container support which is arranged to receive leakage or spillage from a supported container.

Figure 15:
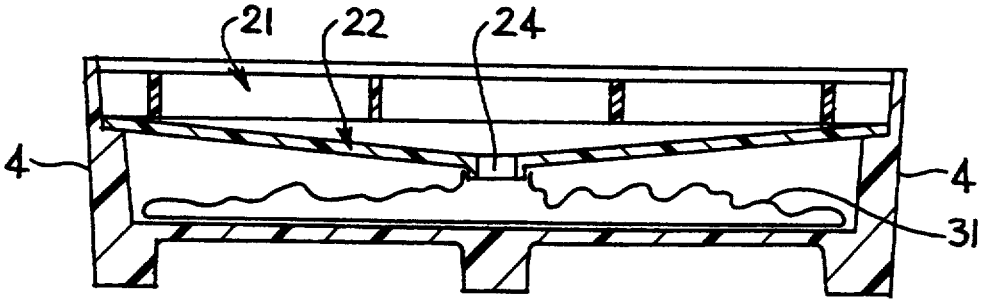
FIG. 15 is a view similar to FIG. 12 and which shows yet another embodiment of the invention.

An alternative approach for collecting material in the space below the support grid is to provide a collection bag within that space. Such an arrangement is illustrated by FIG. 15, which shows a collection bag 31 included in a support similar to that shown in FIG. 12. Obviously, such a bag could be used with supports of other forms. In the FIG. 15 arrangement, the bag 31 is arranged to collect material which passes through the opening 24, and a suitable one-way valve may be associated with that opening if desired.

The bag 31 may be composed of polyethylene or any other suitable material having an appropriate level of chemical resistance for the intended purpose. The bag 31 can therefore provide a corrosion resistant liner for the carrier, which can be removed and replaced as required.

A support according to the invention could also include means for guarding against a build-up of static electricity. Such build-up can create a dangerous situation in circumstances where the support is used with containers which contain flammable material. It is therefore preferred to provide means whereby the support and its load can be connected to a suitable earth or ground. If the support body is made of a suitably conductive material, the aforementioned means may include a conductor between the support and earth. If the support body is not suitably conductive, it may have attached to it one or more conductors which can engage the load and thereby connect the load, and possibly the support also, to earth.

It is also envisaged that means may be provided to hold a container firmly on the support, and in particular resist relative movement between the container and the support during transport. Research indicates that a container will move relative to a supporting pallet when transported over significant distances, and such movement could result in damage to the container. Any suitable restraining means could be adopted, including one or more straps (e.g., with cam locks) attached to the support and engaging the or each container carried by the support. If desired, the same restraining means, or other means, could be used to secure the support to a vehicle by which the support is being transported.

Figure 16:
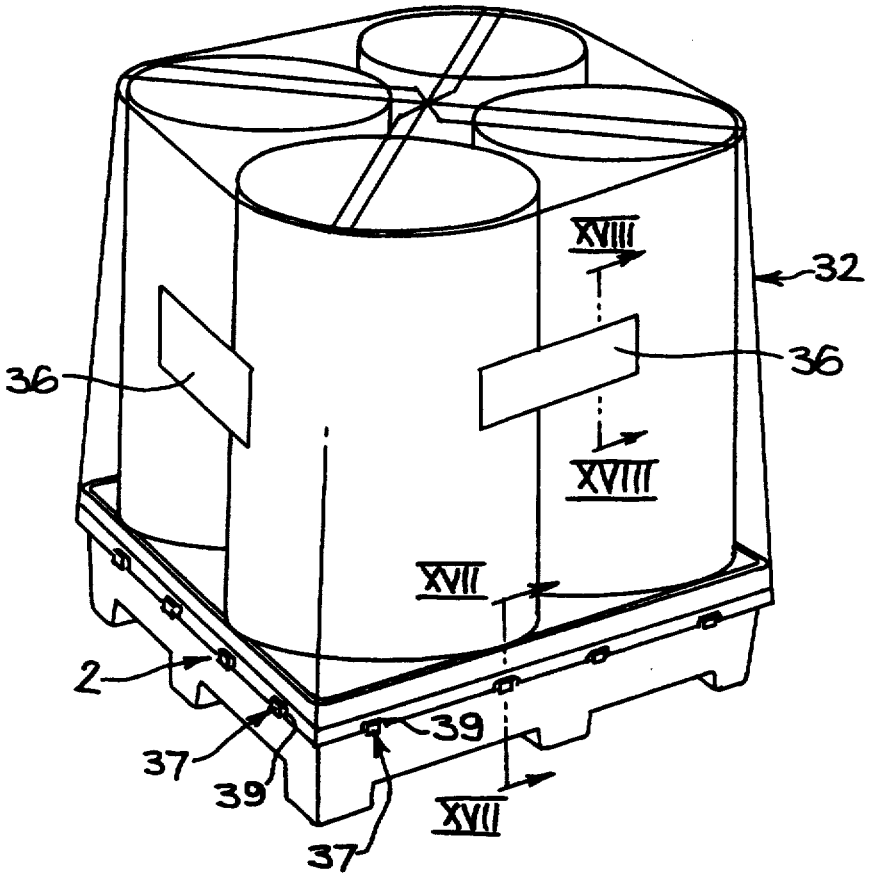
FIG. 16 shows a container support according to the invention carrying a load and having a cover located thereover.

It may be desirable in some circumstances to provide a cover over a support according to the invention and the load carried by that support. One such arrangement is shown in FIG. 16. The cover 32 may be composed of any suitable flexible sheet material such as polyethylene. In one arrangement, a polyethylene sheet having a thickness of approximately 2 mm is used so that the cover is relatively stiff and therefore resistant to dislodgement. It is preferred that the cover 32 provides a complete cover in that it extends below the top edge of the support body 2 so as to guard against ingress of rainwater, for example, into the internal space of the body 2.

Figure 17:
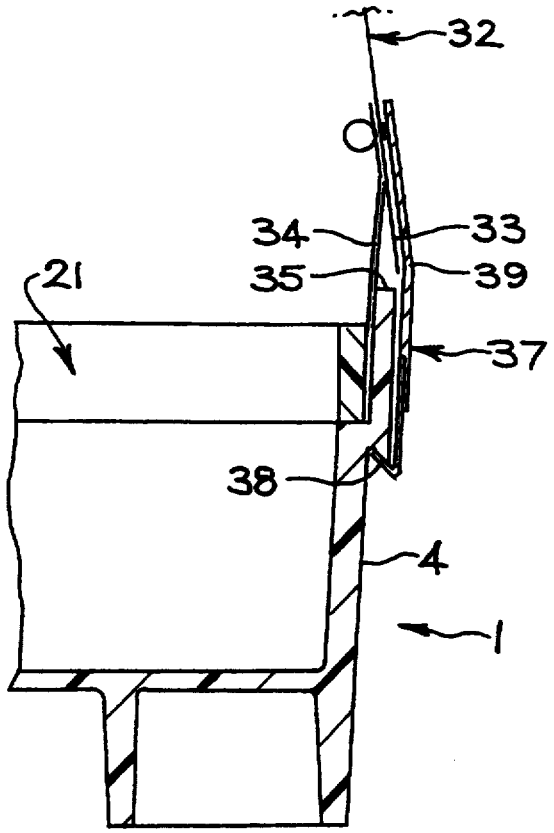
FIG. 17 is a cross-sectional view taken along line XVII—XVII of FIG. 16.

Sealing means may be provided at the lower edge of the cover 32 so as to guard against movement of liquid, or other material, into or out of the support body 2. One form of such sealing means is shown in FIG. 17, in which the cover lower edge is formed by two overlying flaps 33 and 34. The two flaps 33 and 34 are arranged so that each extends over a respective opposite side of the upper edge 35 of the support side wall 4.

Figure 18:
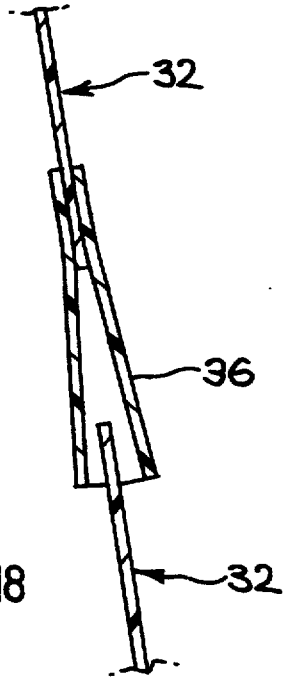
FIG. 18 is a cross-sectional view taken along line XVIII—XVIII of FIG. 16.

One or more air vents 36 may be provided in the wall of the cover 32, and such vents 33 are preferably designed to hinder movement of liquid therethrough in either the inward or the outward direction. The air vent arrangement shown in FIG. 18 is an example arrangement of that kind.

Any suitable means may be employed to releasably attach the cover 32 to the support body 2. The example means shown in FIGS. 16 and 17 includes a number of clips 37 which are secured around the lower edge portion of the cover 32, and each of which is adapted to cooperate with a lip 38 formed at the side wall 4 and located at a suitable position in the height of that wall. It is preferred that the clip includes a resilient member 39 which can be stretched to effect attachment and detachment of the clip 37 to and from the wall lip 38.

A container support according to the invention has a number of advantages over prior supports of the same general kind. The portable nature of the support enables it to be moved with supported drums as a single entity, is an advantage of particular importance. Further, the support is relatively simple and can be manufactured at reasonable cost.

Various alterations, modifications and/or additions may be introduced into the construction and arrangement of the parts previously described without departing from the spirit or ambit of the invention.

Having now described my invention, what I claim as new and desire to secure by Letters Patent is:

1. A combination bund and pallet for supporting at least one container during storage and transport of the at least one container, the combination bund and pallet comprising:

a base;

a continuous side wall upstanding from said base and formed integral with the base;

a collection space surrounded by said side wall for receiving flowable material;

an open grid extending between opposed parts of said side wall and operable to support said at least one container over said base, said open grid having at least one opening allowing said flowable material to pass into said collection space; and anti-surge baffle means located between said base and an upper surface of said open grid, said baffle means being removable through said at least one opening of said open grid.

2. A combination bund and pallet according to claim 1, wherein said grid is integral with said side wall.

3. A combination bund and pallet according to claim 1, wherein said grid is formed of a first material, and said base and said side wall are formed of a second material.

4. A combination bund and pallet according to claim 1, wherein said baffle means includes a plurality of plates each extending from said upper surface of said open grid to said base, and each said plate having at least one flow opening permitting passage of the flowable material from a first side of the plate in said collection space to a second side of the plate in said collection space.

5. A combination bund and pallet according to claim 4, wherein each said flow opening is formed through a lower edge of the respective plate.

6. A combination bund and pallet according to claim 1, further comprising a plurality of sockets provided on an under surface of said base, and each said socket receiving an end portion of a post so that said combination bund and pallet can be supported at an elevated position over a supporting surface.

7. A combination bund and pallet according to claim 1, wherein the base includes drainage means to controllably drain said flowable material from said collection space.

8. A combination bund and pallet according to claim 7, wherein said drainage means permits draining of substantially all of said flowable material from said collection space.

9. A combination bund and pallet for supporting at least one container during storage and transport of the at least one container, the combination bund and pallet comprising:

a base;

a continuous side wall upstanding from said base and formed integral with the base;

a collection space surrounded by said side wall for receiving flowable material;

container support means extending between opposed parts of said side wall and operable to support said at least one container over said base, said container support means having at least one opening allowing said flowable material to pass into said collection space; and a baffle plate extending across said collection space at a location between said base and said container supporting means, the entire baffle plate spaced above the base, at least one opening provided in said baffle plate permitting passage of the flowable material into said collection space.

10. A combination bund and pallet according to claim 9, further comprising a one-way valve provided at said opening of said baffle plate to hinder movement of said flowable material from said collection space through said opening.

11. A combination bund and pallet according to claim 9, wherein said baffle plate includes a plurality of openings, and a one-way valve provided at each said baffle plate opening to hinder movement of said flowable material from said collection space through each said opening.

12. A combination bund and pallet according to claim 9, further comprising a flexible bag provided in said collection space, said baffle plate opening connecting with an interior of said bag so that the flowable material passing through the baffle plate opening is collected within said bag.

13. A combination bund and pallet according to claim 12, wherein said flexible bag is replaceable.

14. A combination bund and pallet for supporting at least one container during storage and transport of the at least one container, the combination bund and pallet comprising:

a base;

a continuous side wall upstanding from said base and formed integral with said base, said base and said side wall formed of cast metal;

a collection space surrounded by said side wall for receiving flowable material;

container supporting means extending between opposed parts of said side wall, said supporting means supporting said at least one container over said base, said supporting means including at least one opening permitting passage of the flowable material into the collection space; and a corrosion resistant laminate provided over surfaces of said base and said side wall exposed to the flowable material received in the collection space, said laminate including a first layer and a second layer, said first layer initially applied to the surfaces of said base and said side wall exposed to the flowable material received in the collection space, said first layer comprising a hard epoxy based material, said second layer applied over the first layer and comprising a polyethylene based material.

15. A combination bund and pallet according to claim 14, wherein said cast metal is spheroidal cast iron.

16. A combination bund and pallet according to claim 14, wherein said cast metal is stainless steel.

17. A combination bund and pallet according to claim 14, wherein said first layer is sprayed to the surfaces of said side wall and said base exposed to the flowable material, and the second layer is sprayed over said first layer before the first layer is completely dry.

18. A combination bund and pallet according to claim 14, wherein each of said first layer and said second layer are approximately 100 microns thick.

19. A combination bund and pallet assembly for supporting at least one container during storage and transport of the at least one container, the combination bund and pallet assembly comprising:

a base;

a continuous side wall upstanding from said base and formed integral with the base;

a collection space surrounded by said side wall for receiving flowable material;

container supporting means extending between opposed parts of said side wall and operable to support said at least one container over said base, at least one opening formed in said supporting means permitting passage of flowable material into said collection space;

at least one container supported on said combination bund and pallet assembly; and a cover over said at least one container, said cover comprising:

a body of flexible sheet material, seal means at a lower edge portion of said body cooperating with an edge portion of the side wall to hinder passage of the flowable material from said combination bund and pallet assembly, and connecting means releasably attaching said cover edge portion to said side wall edge portion.

20. An assembly according to claim 19, wherein said seal means includes a first flap and a second flap, the first flap positioned over an outside surface of said side wall edge portion and the second flap positioned over an inside surface of said side wall edge portion.

21. An assembly according to claim 19, wherein said coverbody includes at least one air vent.

22. A combination bund and pallet for supporting at least one container during storage and transport of the at least one container, the combination bund and pallet comprising:

a base;

a continuous side wall upstanding from said base and formed integral with the base;

a collection space surrounded by said side wall for receiving flowable material;

an open grid extending between opposed parts of said side wall and said base, said open grid integral with said side wall and said base;

container supporting means formed by said grid and supporting said at least one container on an upper supporting surface of said grid, said grid enabling passage of the flowable material from said upper supporting surface of said grid into said collection space;

anti-surge baffle means formed by said grid and extending below said upper supporting surface; and a plurality of flow openings located in intersections of said grid adjacent said base permitting passage of the flowable material from one region of said collection space to another region of said collection space.

23. A combination bund and pallet according to claim 22, wherein said base, said side wall and said grid are formed as a single unit from a plastics material.

24. A combination bund and pallet according to claim 22, further comprising drainage means enabling the flowable material to drain from said collection space.

25. A combination bund and pallet according to claim 22, wherein said base and said side wall are formed of cast metal.

* * * * *